US010787999B2

(12) United States Patent
Asanuma

(10) Patent No.: US 10,787,999 B2
(45) Date of Patent: Sep. 29, 2020

(54) EVAPORATED FUEL PROCESSING APPARATUS

(71) Applicant: AISAN KOGYO KABUSHIKI KAISHA, Obu-shi, Aichi-ken (JP)

(72) Inventor: Daisaku Asanuma, Gamagori (JP)

(73) Assignee: AISAN KOGYO KABUSHIKI KAISHA, Obu-shi (JP)

( * ) Notice: Subject to any disclaimer, the term of this patent is extended or adjusted under 35 U.S.C. 154(b) by 0 days.

(21) Appl. No.: 16/273,421

(22) Filed: Feb. 12, 2019

(65) Prior Publication Data

US 2019/0301403 A1 Oct. 3, 2019

(30) Foreign Application Priority Data

Mar. 29, 2018 (JP) ..... 2018-063677

(51) Int. Cl.
*F02M 25/08* (2006.01)

(52) U.S. Cl.
CPC ..... *F02M 25/0836* (2013.01); *F02M 25/089* (2013.01); *F02M 25/0854* (2013.01); *F02M 25/0872* (2013.01)

(58) Field of Classification Search
CPC ..... F02M 25/08; F02M 25/0836; F02M 25/0854; F02M 25/0872; F02M 25/089
See application file for complete search history.

(56) References Cited

U.S. PATENT DOCUMENTS 6,014,958 A * 1/2000 Miwa ..... F02M 25/08 123/516
10,035,417 B2 * 7/2018 Tochihara ..... F02M 25/0836
10,352,260 B2 * 7/2019 Tochihara ..... F02M 25/0809

FOREIGN PATENT DOCUMENTS

JP 2003-278590 A 10/2003
JP 2017-180320 A 10/2017
JP 2019002304 A * 1/2019 ..... F02M 25/08

* cited by examiner

*Primary Examiner* — Hieu T Vo
(74) *Attorney, Agent, or Firm* — Oliff PLC

(57) ABSTRACT

An evaporated fuel processing apparatus is provided with a canister to collect vapor, a purge passage to purge the vapor collected in the canister to an intake passage, a purge valve provided in the purge passage to regulate a purge flow rate of the vapor, a purge pump provided between the canister and the purge valve to pressure-feed the vapor from the canister to the purge passage, and a vapor pressure sensor to detect vapor pressure in the purge passage. An inside of the canister is communicated with the atmosphere, a capacity chamber (the canister) is provided upstream of the purge pump, and the vapor pressure sensor is provided in the purge passage between the purge valve and the purge pump.

3 Claims, 4 Drawing Sheets

EVAPORATED FUEL PROCESSING APPARATUS

CROSS-REFERENCE TO RELATED APPLICATIONS

This application is based upon and claims the benefit of priority from the prior Japanese Patent Application No. 2018-063677 filed on Mar. 29, 2018, the entire contents of which are incorporated herein by reference.

BACKGROUND

Technical Field

The technique disclosed in this specification relates to an evaporated fuel processing apparatus configured such that evaporated fuel generated in a fuel tank is once collected in a canister and purged into an intake passage through a purge passage provided with a purge valve and a purge pump so that the evaporated fuel is processed.

Related Art

Heretofore, an "evaporated fuel processing apparatus" described in JP2017-180320A has been known as one example of this technique. This apparatus is provided with an aim of preferably estimating a flow rate of purge gas (evaporated fuel or vapor) fed out by a pump. To be more specific, the apparatus includes a canister for absorbing (collecting) vapor generated in a fuel tank, a purge channel (purge passage) for purging the vapor from the canister to an intake passage of the engine, a pump (purge pump) for feeding the vapor from the canister to the intake passage, a control valve (purge valve) for controlling vapor flow in the purge passage, a branch passage (bypass passage) detouring a part of the purge passage, a pressure specification part for specifying a pressure difference between front and rear of a small diameter part on the bypass passage, an air-fuel ratio sensor of the engine, and an estimation unit for estimating a flow rate of the vapor fed out of the purge pump based on a vapor concentration that is estimated by a detection value detected by the air-fuel ratio sensor and a pressure difference (corresponding to a discharge pressure of the purge pump) specified by the pressure specification part.

SUMMARY

Technical Problems

The apparatus described in JP2017-180320A however has a tendency of increase in pressure pulsation on a downstream side of the purge pump. Accordingly, in order to obtain a stable pressure difference between an upstream side and the downstream side of the purge pump for estimating a flow rate of the vapor, pressure sensors need to be provided on both sides of the upstream side and the downstream side of the purge pump. In this case, two pressure sensors need to be provided and the pressure difference from the atmospheric pressure needs to be calculated from detection values detected by the two pressure sensors. This tends to make the apparatus structure complicated and to increase costs.

Herein, the vapor concentration is estimated by a discharge pressure of the purge pump when the purge pump is under operation and the purge valve is closed. Accordingly, stable detection of the discharge pressure of the purge pump leads to highly accurate estimation of the vapor concentration.

The present disclosure has been made in view of the above circumstances and has an aim of providing an evaporated fuel processing apparatus achieving stable detection of the discharge pressure of the purge pump with a simple configuration to estimate the concentration of the evaporated fuel.

Means of Solving the Problems

One aspect of the present disclosure to solve the above problem is to provide an evaporated fuel processing apparatus configured to process evaporated fuel generated in a fuel tank without discharging the evaporated fuel into the atmosphere, wherein the evaporated fuel processing apparatus includes: a canister configured to collect the evaporated fuel generated in the fuel tank; a purge passage configured to purge the evaporated fuel collected in the canister to an intake passage of an engine; a purge valve provided in the purge passage to regulate a purge flow rate of the evaporated fuel; a purge pump provided in the purge passage between the canister and the purge valve to pressure-feed the evaporated fuel into the purge passage from the canister; and a pressure detection member configured to detect the pressure of the evaporated fuel in the purge passage, an inside of the canister communicates with the atmosphere, a capacity chamber having a predetermined capacity is provided upstream of the purge pump, and the pressure detection member is provided in the purge passage between the purge valve and the purge pump.

According to the above technique, in estimating the concentration of the evaporated fuel, the discharge pressure of the purge pump can be stably detected with a simple configuration configured with a single pressure detection member.

DETAILED DESCRIPTION OF THE EXEMPLARY EMBODIMENTS

<First Embodiment>

A first embodiment embodying an evaporated fuel processing apparatus in a gasoline engine system is now explained below with reference to the accompanying drawings.

(Overview of Engine System)

Figure 1:
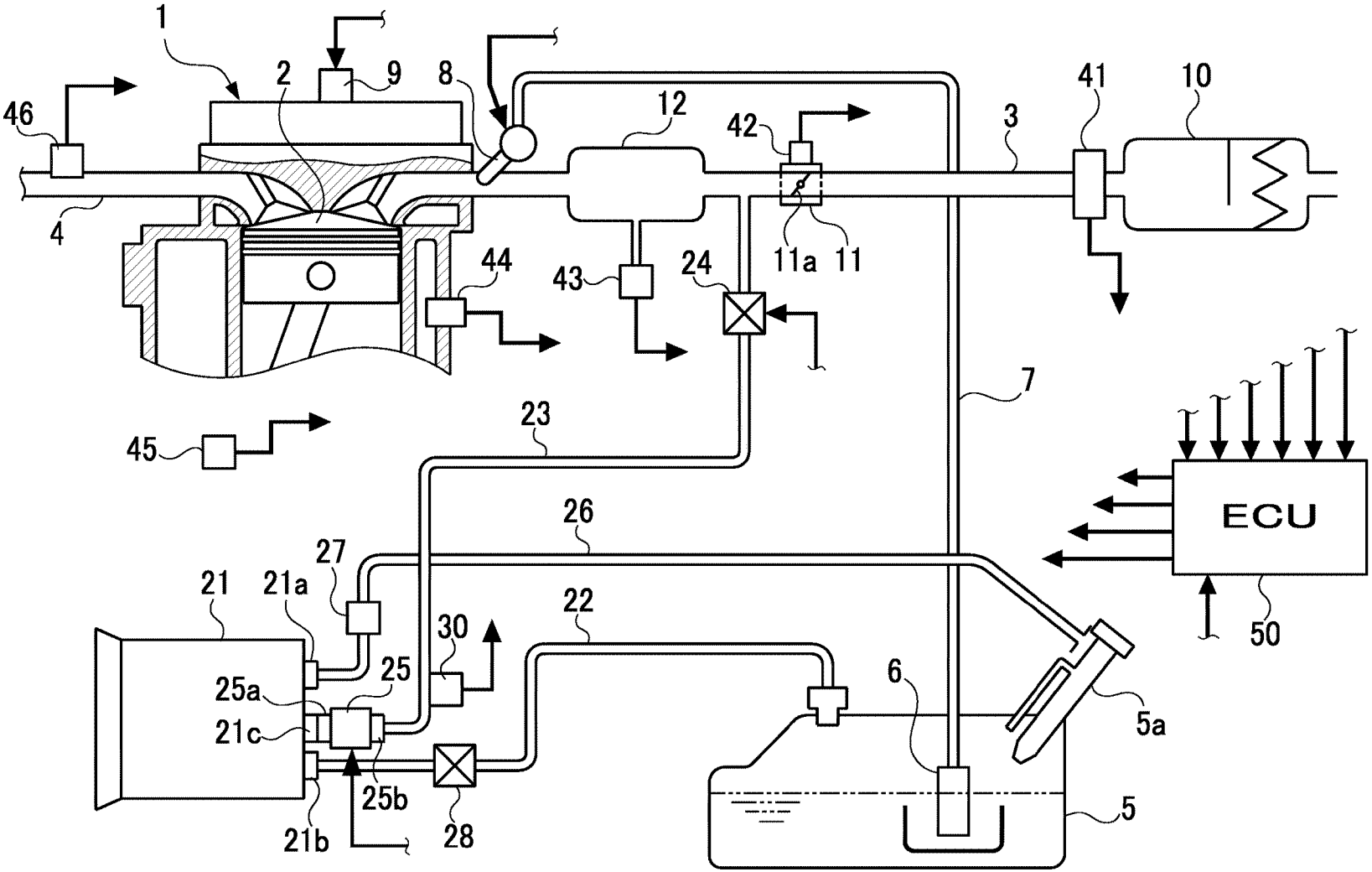
FIG. 1 is a schematic configurational view of an engine system including an evaporated fuel processing apparatus in a first embodiment.

FIG. 1 is a schematic configurational view of an engine system including an evaporated fuel processing apparatus. An engine 1 is provided with an intake passage 3 to take air and others into a combustion chamber 2 and an exhaust passage 4 to discharge exhaust gas from the combustion chamber 2. To the combustion chamber 2, fuel stored in a fuel tank 5 is supplied. Specifically, the fuel in the fuel tank 5 is discharged to a fuel passage 7 by a fuel pump 6 embedded in the fuel tank 5 and then pressure-fed to an injector 8 provided in an intake port of the engine 1. The thus fed fuel is injected through the injector 8 and introduced in the combustion chamber 2 with air having been flowing through the intake passage 3 to form combustible air-fuel mixture used for combustion. The engine 1 is provided with an ignition device 9 for igniting the combustible air-fuel mixture.

In the intake passage 3, there are provided an air cleaner 10, a throttle device 11, and a surge tank 12 in this order from an inlet side of the passage 3 toward the engine 1. The throttle device 11 is provided with a throttle valve 11*a* which is opened or closed to regulate an intake flow rate of intake air flowing in the intake passage 3. Opening and closing operation of the throttle valve 11*a* is associated with operation of an accelerator pedal (not shown) operated by a driver. The surge tank 12 smoothens intake pulsation in the intake passage 3.

(Configuration of Evaporated Fuel Processing Apparatus)

An evaporated fuel processing apparatus of the present embodiment is configured to process the evaporated fuel (vapor) generated in the fuel tank 5 without discharging the fuel into the air. This apparatus is provided with a canister 21 to collect the vapor generated in the fuel tank 5, a vapor passage 22 to introduce the vapor into the canister 21 from the fuel tank 5, a purge passage 23 to purge the vapor collected in the canister 21 into the intake passage 3, a purge valve 24 provided in the purge passage 23 to adjust a purge flow rate of the vapor, a purge pump 25 provided between the canister 21 and the purge valve 24 to pressure-feed the vapor from the canister 21 to the purge passage 23, and a vapor pressure sensor 30 to detect a pressure of the vapor (a vapor pressure or a discharge pressure of the purge pump 25) in the purge passage 23. The vapor pressure sensor 30 corresponds to one example of a pressure detection member of the present disclosure.

The canister has an inner space with a predetermined capacity internally provided with an absorbent such as an activated charcoal. The canister 21 includes an atmospheric port 21*a* to introduce the atmosphere, an inflow port 21*b* to introduce the vapor, and an outflow port 21*c* to discharge the vapor. The inner space of the canister 21 is communicated with the atmosphere. In other words, a leading end of an atmospheric passage 26 extending from this atmospheric port 21*a* is communicated with an inlet of a fuel-supply cylinder 5*a* of the fuel tank 5. The atmospheric passage 26 is provided with a filter 27 for capturing mine dust in the air. A leading end of the vapor passage 22 extending from the inflow port 21*b* of the canister 21 is communicated with an inside of the fuel tank 5. A leading end of the purge passage 23 provided between the canister 21 and the intake passage 3 is communicated with the intake passage 3 between the throttle device 11 and the surge tank 12.

In the present embodiment, the purge valve 24 is constituted of a motor-operated valve (VSV) and is variable in its opening degree for adjusting the vapor flow rate. The purge pump 25 is configured to be variable in a discharge amount of the vapor which is to be pressure-fed from the canister 21 to the purge passage 23. As an example of the purge pump 25, a turbopump may be adopted. The purge pump 25 includes an intake port 25*a* to intake the vapor and an exhaust port 25*b* to exhaust the vapor. A capacity chamber having a predetermined capacity is provided upstream of the purge pump 25. In the present embodiment, the capacity chamber is constituted of the inner space of the canister 21. The purge pump 25 is directly provided in the canister 21 and the intake port 25*a* of the pump 25 is connected to the outflow port 21*c* of the canister 21. Further, a vapor pressure sensor 30 is provided in the purge passage 23 downstream of the purge pump 25.

The evaporated fuel processing apparatus configured as above introduces the vapor generated in the fuel tank 5 to the canister 21 through the vapor passage 22 and once collects the vapor in the canister 21. During operation of the engine 1, the throttle device 11 (the throttle valve 11*a*) is opened, the purge valve 24 is opened, and the purge pump 25 is operated. Thus, the vapor captured in the canister 21 is purged into the intake passage 3 from the canister 21 through the purge passage 23.

In the present embodiment, a cutoff valve 28 for controlling air flow between the fuel tank 5 and the canister 21 is provided in the vapor passage 22. This cutoff valve 28 is made to open when an inner pressure of the fuel tank 5 is positive at a predetermined value or more and is made to close by negative pressure generated when the vapor captured in the canister 21 is purged into the intake passage 3.

(Electrical Configuration of Engine System)

In the present embodiment, various sensors 41 to 46 for detecting an operation state of the engine 1 are provided. An air flow meter 41 provided near the air cleaner 10 detects an amount of air taken in the intake passage 3 as an intake air flow rate and outputs an electrical signal corresponding to the detected value. A throttle sensor 42 provided in the throttle device 11 detects an open degree of the throttle valve 11*a* as a throttle opening degree and outputs an electrical signal corresponding to the detected value. An intake air pressure sensor 43 provided in the surge tank 12 detects pressure in the surge tank 12 as an intake air pressure and outputs an electrical signal corresponding to the detected value. A water temperature sensor 44 provided in the engine 1 detects a temperature of a cooling water flowing inside the engine 1 as a cooling-water temperature and outputs an electrical signal corresponding to the detected value. A rotation speed sensor 45 provided in the engine 1 detects rotation angular speed of a crank shaft (not shown) of the engine 1 as an engine rotation speed and outputs an electrical signal corresponding to the detected value. An oxygen sensor 46 provided in the exhaust passage 4 detects oxygen concentration in the exhaust gas and outputs an electrical signal corresponding to the detected value. Further, in the purge passage 23 between the purge valve 24 and the purge pump 25, the vapor pressure sensor 30 to detect the discharge pressure (vapor pressure) of the vapor discharged from the purge pump 25 is provided. The vapor pressure detected by the vapor pressure sensor 30 is used for estimating a vapor concentration as explained below.

In the present embodiment, an electronic control unit (ECU) taking in charge of various control inputs or receives various signals which are output from the respective sensors 30 and 41 to 46. The ECU 50 controls the injector 8, the ignition device 9, the purge valve 24, and the purge pump 25 based on these input signals to carry out fuel injection control, ignition timing control, purge control, vapor-concentration estimation control, and others.

The fuel injection control is to control a fuel injection amount and a fuel injection timing by controlling the injector 8 according to an operation state of the engine 1. The ignition timing control is to control a timing for igniting the combustible air-fuel mixture by controlling the ignition device 9 according to the operation state of the engine 1. The purge control is to control the purge flow rate of the vapor purged from the canister 21 to the intake passage 3 by controlling the purge valve 24 and the purge pump 25 according to the operation state of the engine 1. Further, the vapor concentration estimation control is to estimate the vapor concentration in the purge passage 23 based on detected values of the vapor pressure or the like. Detailed explanation for a method of estimating the vapor concentration is omitted in the present disclosure.

In the present embodiment, the ECU 50 corresponds to one example of a control member of the present disclosure. The ECU 50 is provided with a known configuration including a central processing unit (CPU), a read-only memory (ROM), a random-access memory (RAM), and a back-up RAM. The ROM stores in advance predetermined control programs related to the above-mentioned various control operation. The ECU (CPU) 50 is made to carry out the above-mentioned various control operation according to these control programs.

(Operations and Effects of Evaporated Fuel Processing Apparatus)

In the evaporated fuel processing apparatus of the above-mentioned present embodiment, detection values of the vapor pressure sensor 30 need to be sampled in order to detect pressure of the vapor discharged out of the purge pump 25 during operation of the pump 25 while the purge valve is closed. This apparatus is configured such that an inside of the canister 21 is communicated with the atmosphere and that a capacity chamber (the canister 21) having a predetermined capacity is provided upstream of the purge pump 25. Accordingly, during operation of the purge pump 25, pressure pulsation of the vapor pressure on an upstream side of the pump 25 is attenuated and the vapor pressure on the upstream side has less influence on a downstream side of the pump 25, thus restraining the pressure pulsation of the vapor pressure on the downstream side. Therefore, providing the single vapor pressure sensor 30 for estimating the vapor concentration is enough to achieve stable detection of the discharge pressure of the purge pump 25 with a simple configuration of the evaporated fuel processing apparatus. As a result, the vapor concentration can be accurately estimated based on the vapor pressure and others.

Figure 2:
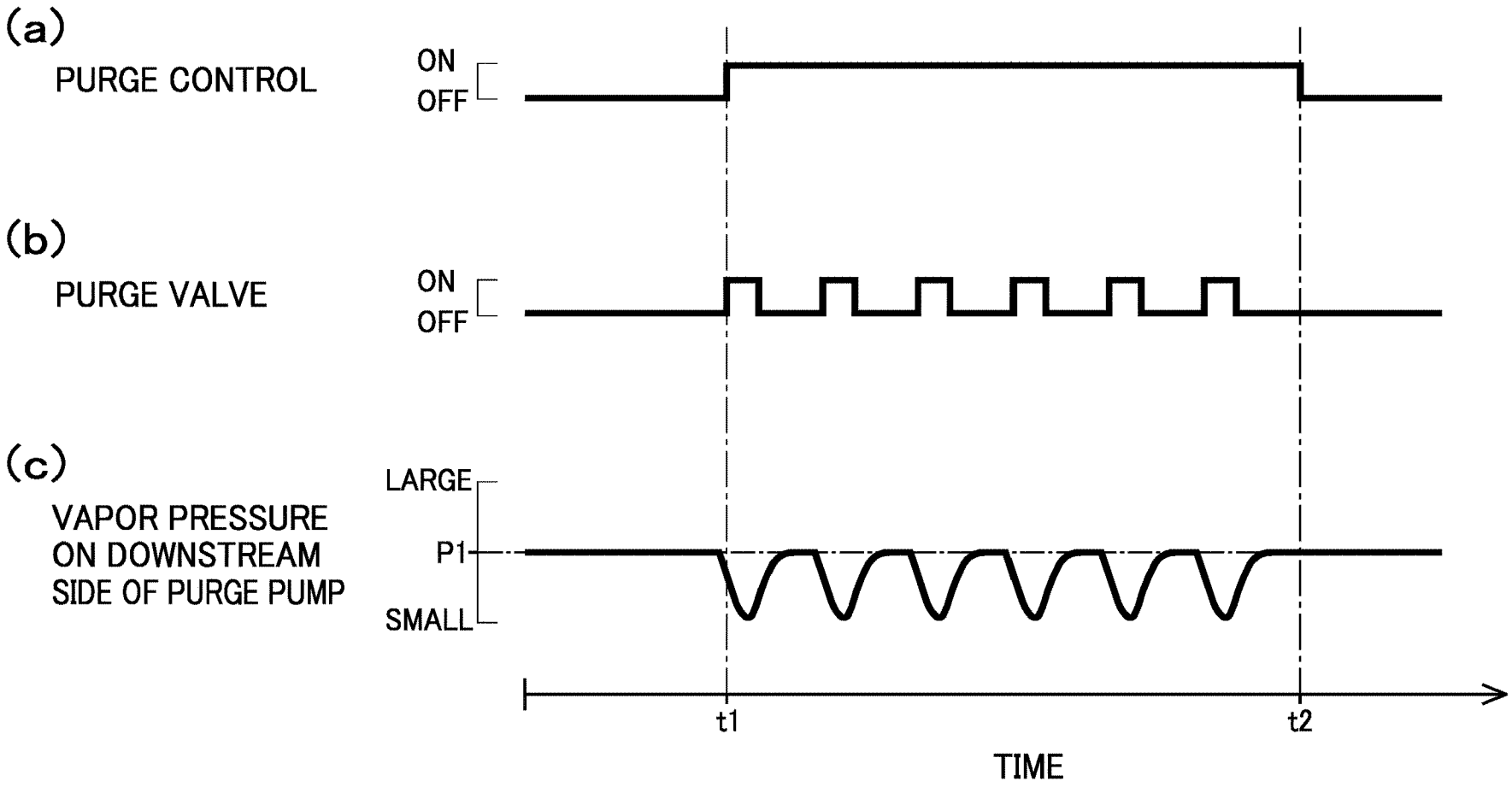
FIG. 2 is a time chart showing behavior of each parameter during purge control in the first embodiment.
Figure 3:
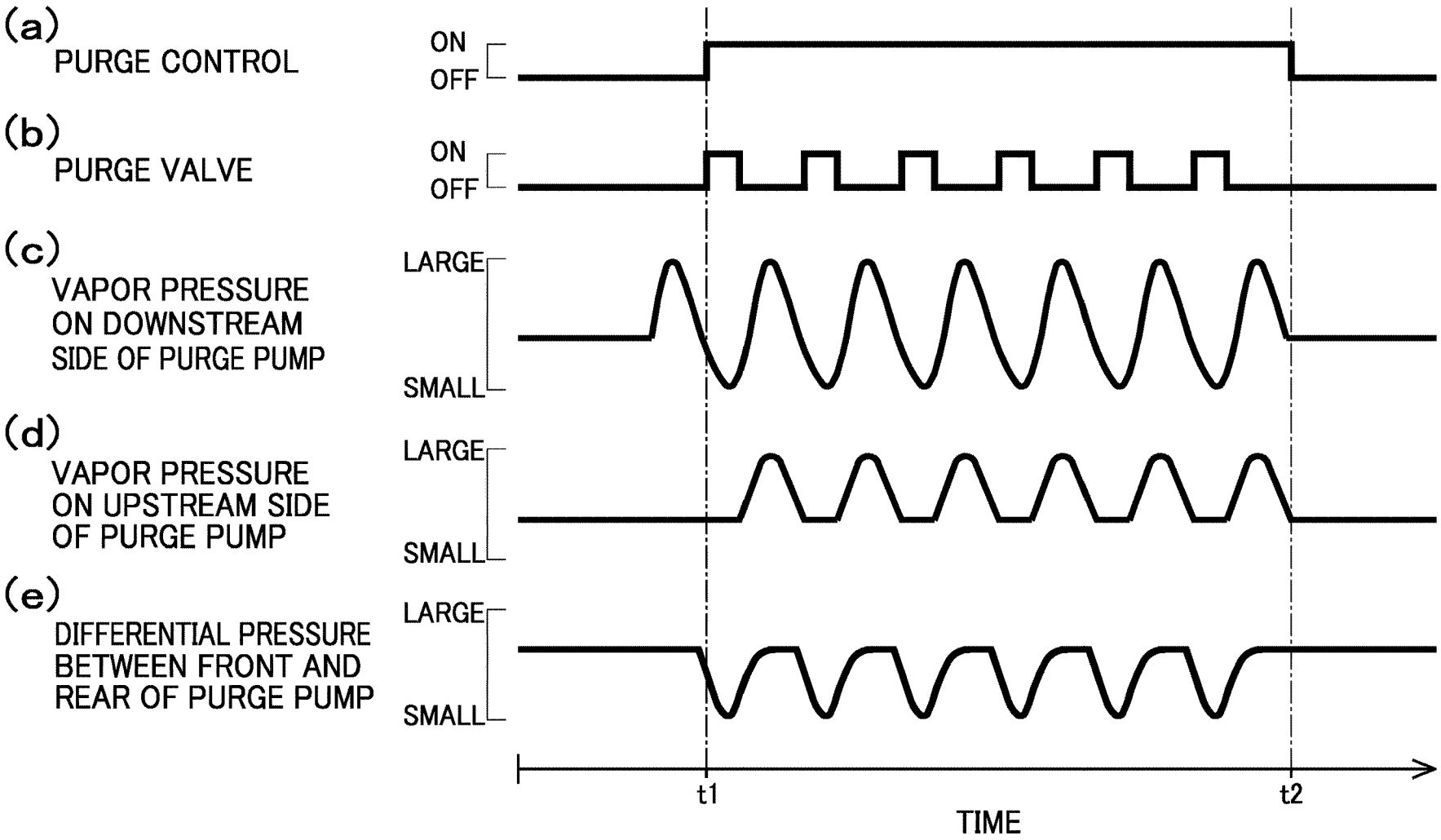
FIG. 3 RELATED ART
FIG. 3 is a time chart showing behavior of each parameter during the purge control in a comparative example.

Detection results detected by the vapor pressure sensor 30 in purge control operation of the present embodiment are explained below. FIG. 2 is a time chart indicating behavior of respective parameters in the purge control of the present embodiment. In FIG. 2, a graph indicated with an annotated sign (a) represents the purge control, a graph with a sign (b) represents duty control of the purge valve, and a graph with a sign (c) represents the vapor pressure on the downstream side of the purge pump (a downstream-side vapor pressure). FIG. 3 is a time chart indicating behavior of respective parameters in a conventional purge control operation as a comparative example. In FIG. 3, a graph indicated with an annotated sign (a) represents the purge control, a graph with a sign (b) represents the duty control of the purge valve, a graph with a sign (c) represents the downstream-side vapor pressure detected by a vapor pressure sensor on the downstream side of the purge pump, a graph with a sign (d) represents the upstream-side vapor pressure detected by the vapor pressure sensor on the upstream-side of the purge pump, and a graph with a sign (e) represents a purge-pump front-rear differential pressure (a pressure difference between the upstream-side vapor pressure and the downstream-side vapor pressure).

In the present embodiment, as shown in (a) of FIG. 2, the purge control is carried out during a term between a time t1 to t2 to operate the purge pump 25, and the purge valve 24 is switched on or off at a predetermined duty ratio as shown in (b), so that the downstream-side vapor pressure indicated in (c) is obtained. In this operation, the downstream-side vapor pressure detected by a single vapor pressure sensor 30 reaches a pressure P1 that is a pressure before carrying out the purge control, a certain lower limit at a time when the purge valve 24 is on (opened), or a certain upper limit, which is almost the same with the pressure P1, at a time when the purge valve 24 is off (closed). Thus, according to the present embodiment, providing only the single vapor pressure sensor 30 can achieve obtention of the stable downstream-side vapor pressure from the value detected by the sensor 30.

On the other hand, in the conventional example, as shown in (a) of FIG. 3, the purge control is carried out during a term between a time t1 to t2 to operate the purge pump, and as shown in (b), the purge valve 24 is switched to be on or off at a predetermined duty ratio, causing pressure pulsation of the upstream-side vapor pressure as shown in (d). This pulsation has influence on increase in the pressure pulsation of the downstream-side vapor pressure indicated in (c). As indicated in (e), a pressure waveform as similar to that of (c) of FIG. 2 is obtained by calculating the pressure difference between the upstream-side vapor pressure and the downstream-side vapor pressure, but there needs to provide the purge pressure sensor on each of the upstream side and the downstream side of the purge pump in this conventional example, and further, the pressure difference between the upstream-side vapor pressure and the downstream-side vapor pressure needs to be obtained from the detected values.

Further, in the present embodiment, the capacity chamber is constituted of an inner space of the canister 21. The purge pump 25 is directly provided in the canister 21 and the intake port 25*a* is connected to the outflow port 21*c* of the canister 21. Therefore, there is no need to separately provide a capacity chamber. This achieves further simplification of the configuration of the evaporated fuel processing apparatus and size reduction of the apparatus.

<Second Embodiment>

A second embodiment embodying an evaporated fuel processing apparatus in a gasoline engine system is now explained in detail with reference to the accompanying drawings.

In the following explanation, similar or identical parts or components to those of the first embodiment are assigned with the same reference signs as those in the first embodiment and their explanations are omitted as appropriate. Therefore, the following explanation is made with a focus on the differences from the first embodiment.

(Configuration of Evaporated Fuel Processing Apparatus)

Figure 4:
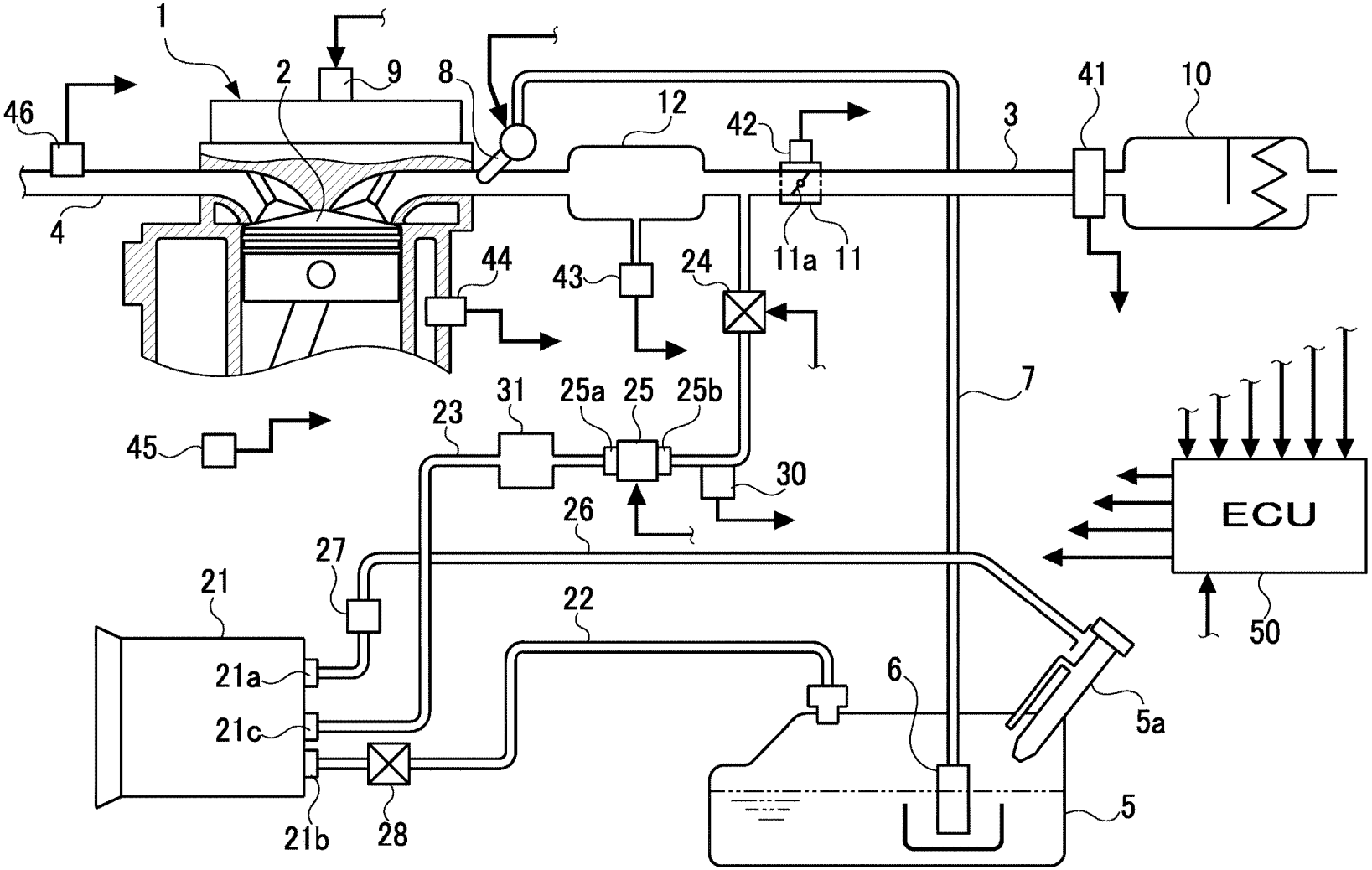
FIG. 4 a schematic configurational view of an engine system including an evaporated fuel processing apparatus in a second embodiment.

FIG. 4 is a schematic configurational view of an engine system including an evaporated fuel processing apparatus. In the present embodiment, arrangement of the purge pump 25 and the capacity chamber is different from that of the first embodiment. Specifically, the purge pump 25 of the present embodiment is provided in the purge passage 23 between the canister 21 and the purge valve 24. Further, a capacity chamber 31 separately provided from the canister 21 is placed in the purge passage 23 upstream of the purge pump 25. Herein, a capacity of the capacity chamber 31 may be set about "1000 cc". The capacity chamber 31 can be provided by increasing an inner diameter of the purge passage 23 between the canister 21 and the purge pump 25.

Accordingly, the evaporated fuel processing apparatus of the present embodiment can also achieve the configuration of communicating the inside of the canister 21 with the atmosphere and the apparatus is provided with the capacity chamber 31 having a predetermined capacity on an upstream side of the purge pump 25. Thus, the pressure pulsation of the vapor pressure on the upstream side of the purge pump

25 is attenuated during operation of the purge pump 25 and the vapor pressure on the upstream side has less influence on the downstream-side of the pump 25, thus restraining the pressure pulsation of the vapor pressure on the downstream side. Therefore, providing the single vapor pressure sensor 30 to estimate the vapor concentration can achieve simplification of the configuration of the evaporated fuel processing apparatus and stable detection of the discharge pressure of the purge pump 25. This results in accurate estimation of the vapor concentration based on the vapor pressure and others.

The present disclosure is not limited to each of the above embodiments and may be applied with various changes in its part of configuration without departing from the scope of the disclosure.

In the above embodiments, an engine system with no supercharger being provided is configured such that the vapor is purged into the intake passage 3 downstream of the throttle device 11 from the purge passage 23. Alternatively, an engine system may be provided with a supercharger and configured such that the vapor is purged into the intake passage upstream of the throttle device and downstream of the air flow meter from the purge passage.

INDUSTRIAL APPLICABILITY

The present disclosure may be applied to an engine system provided with an evaporated fuel processing apparatus.

REFERENCE SIGNS LIST

1 Engine
3 Intake passage
5 Fuel tank
21 Canister
21*a* Atmospheric port
21*b* Inflow port
21*c* Outflow port
22 Vapor passage
23 Purge passage
24 Purge valve
25 Purge pump
25*a* Intake port
25*b* Exhaust port
30 Vapor pressure sensor (Pressure detection member)
31 Capacity chamber

What is claimed is:

1. An evaporated fuel processing apparatus configured to process evaporated fuel generated in a fuel tank without discharging the evaporated fuel into the atmosphere, wherein the evaporated fuel processing apparatus includes:

a canister configured to collect the evaporated fuel generated in the fuel tank;

a purge passage configured to purge the evaporated fuel collected in the canister to an intake passage of an engine;

a purge valve provided in the purge passage to regulate a purge flow rate of the evaporated fuel;

a purge pump provided in the purge passage between the canister and the purge valve to pressure-feed the evaporated fuel into the purge passage from the canister;

a pressure detection member configured to detect the pressure of the evaporated fuel in the purge passage; and a control unit configured to control the purge valve and the purge pump, and to estimate a concentration of the evaporated fuel in the purge passage based on the pressure of the evaporated fuel that is detected by the pressure detection member, an inside of the canister communicates with the atmosphere, a capacity chamber having a predetermined capacity is provided upstream of the purge pump, the pressure detection member is provided in the purge passage between the purge valve and the purge pump and is configured to detect the pressure of the evaporated fuel downstream of the purge pump, and the control unit is configured to control the purge valve during operation of the purge pump and to estimate the concentration of the evaporated fuel based on the pressure of the evaporated fuel that is detected by the pressure detection member before the purge valve is controlled and a minimum pressure of the evaporated fuel that is detected by the pressure detection member when the purge valve turns on.

2. The evaporated fuel processing apparatus according to claim 1, wherein the purge pump includes an intake port configured to intake the evaporated fuel and a discharge port configured to discharge the evaporated fuel, the canister includes an atmospheric port configured to introduce the atmosphere, an inflow port configured to introduce the evaporated fuel, and an outflow port configured to discharge the evaporated fuel, the capacity chamber is constituted of an inner space of the canister, and the purge pump is accompanied with the canister and the intake port is connected to the outflow port of the canister.

3. The evaporated fuel processing apparatus according to claim 1, wherein the purge pump is provided in the purge passage between the canister and the purge valve, and the capacity chamber is provided in the purge passage upstream of the purge pump.

* * * * *